US006466178B1

(12) United States Patent
Muterspaugh

(10) Patent No.: US 6,466,178 B1
(45) Date of Patent: Oct. 15, 2002

(54) SMALL-SIZE UNIDIRECTIONAL ANTENNA

(75) Inventor: Max Ward Muterspaugh, Indianapolis, IN (US)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 09/653,603

(22) Filed: Aug. 31, 2000

(51) Int. Cl.[7] ..... H01Q 9/28
(52) U.S. Cl. ..... 343/795; 343/749; 343/803
(58) Field of Search ..... 343/793, 803, 343/739, 740, 795, 749

(56) References Cited

U.S. PATENT DOCUMENTS

| | | | | |
|---|---|---|---|---|
| 2,247,743 A | | 7/1941 | Beverage | |
| 2,533,529 A | * | 12/1950 | Spindler | 250/33 |
| 2,666,138 A | * | 1/1954 | Ehrbar et al. | 250/33 |
| 2,702,347 A | * | 2/1955 | Spindler | 250/33.59 |
| 2,888,678 A | * | 5/1959 | Weiss et al. | 343/814 |
| 4,853,705 A | * | 8/1989 | Landt | 343/803 |
| 5,696,372 A | * | 12/1997 | Grober et al. | 250/216 |
| 6,054,963 A | | 4/2000 | Muterspaugh | 33/741 |
| 6,091,374 A | * | 7/2000 | Barnes | 343/787 |
| 6,285,336 B1 | * | 9/2001 | Zimmerman | 343/803 |
| 6,323,821 B1 | | 11/2001 | McLean | 343/752 |

OTHER PUBLICATIONS

J. J. Gibson and R. M. Wilson, "The Mini–state—A small Television Antenna," IEEE Trans. Consumer Electron., vol. CE–22, No. 2, May 1976, pp. 159–175.

* cited by examiner

*Primary Examiner*—Don Wong
*Assistant Examiner*—Shih-Chao Chen
(74) *Attorney, Agent, or Firm*—Joseph S. Tripoli; Kuniyuki Akiyama

(57) ABSTRACT

A broadband folded dipole antenna has a pair of load resistors in the vicinity of the edges of the antenna element for obtaining a unidirectional beam pattern.

3 Claims, 4 Drawing Sheets

SMALL-SIZE UNIDIRECTIONAL ANTENNA

FIELD OF THE INVENTION

The invention concerns an antenna for receiving broadcast signals.

BACKGROUND INFORMATION

Conventional VHF/UHF television broadcast receiving antennas are designed to receive signals from only one direction. They are often referred as "unidirectional antennas." This unidirectional feature is important primarily because (1) it provides antennas with some front gain and (2) because it rejects undesirable multipath signals, which may cause multipath or "ghost" interference problems. One of the problems associated with conventional unidirectional antennas is that they, especially VHF ones, are relatively large in physical dimensions, having numbers of antenna elements. Therefore, a need exists to develop a relatively small-size unidirectional antenna. It is also preferable to make such a unidirectional antenna capable of receiving both VHF and UHF television broadcast signals.

SUMMARY

In accordance with the invention, a folded dipole antenna has a pair of load resistance elements which are located in the vicinity of the respective edges of the antenna element for obtaining a unidirectional beam pattern.

BRIEF DESCRIPTION OF THE DRAWINGS

The invention may be better understood by referring to the enclosed drawing in which.

DESCRIPTION OF THE PREFERRED EMBODIMENTS

Figure 1:
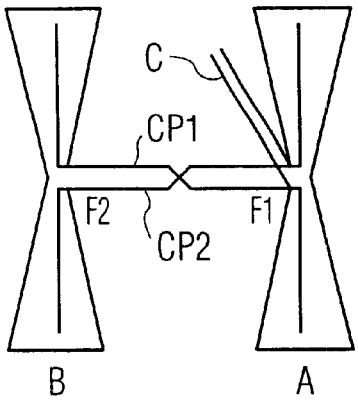
FIG. 1 illustrates the structure of a combination of two folded bow-tie antennas.
Figure 2:
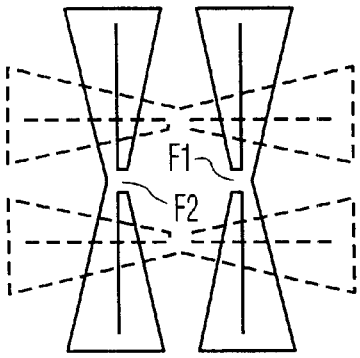
FIG. 2 illustrates two combined folded bow-tie antennas which are placed at right angles over each other.
Figure 3:
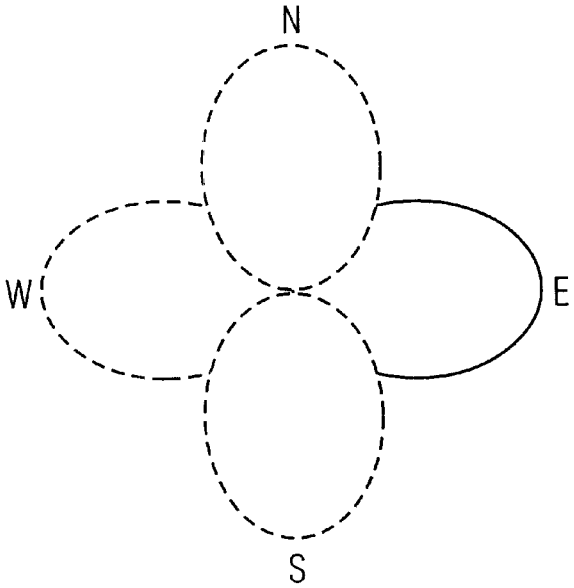
FIG. 3 illustrates a four direction beam pattern of the combined folded bow-tie antennas shown in FIG. 2.

FIGS. 1–3 depict an array of four folded bow-tie antennas which exhibits four reception patterns each of which has an approximately 90 degree beamwidth. The U.S. Pat. No. 6,054,963 entitled "FOLDED BOW-TIE ANTENNA" issued in the name of Max W. Muterspaugh on Apr. 25, 2000 discloses a "folded bow-tie antenna" (hereinafter called "bow-tie antenna") discussed herein--namely, an antenna having a bow-tie loop structure and capable of receiving signals throughout the entire VHF and UHF broadcast bands of frequencies.

In FIG. 1, two bow-tie antennas are connected by two conductive paths CP1, CP2 which are crossed to reverse the phase of the signals received. The received signals are taken at a feed point of one of the two antennas. In this example, feeder C is coupled to feed point F1 of bow-tie antenna A. Feeder C can be coupled to feed point F2 of bow tie antenna B so that the beam pattern of the combined antennas can be changed.

More specifically, when receiving a signal which approaches bow-tie antenna A first, it induces a voltage on bow-tie antenna A. However, when the same signal arrives at bow-tie antenna B, its phase has changed 90 degrees. Furthermore, when this signal passes to bow-tie antenna A through the conductive paths, its phase changes another 90 degrees. In addition, due to the cross connection of the conductive paths, the signal additionally changes 180 degrees in phase. As a result, the signal received by bow-tie antenna B has changed 360 degrees in phase when it arrives at feed point F1 of bow-tie antenna A and then is combined with the signal received by bow-tie antenna A. That is to say, the combination of dipole antenna is capable of receiving signals which approach bow-tie antenna A first.

On the other hand, when receiving a signal which approaches bow-tie antenna B first, the received signal by bow-tie antenna B changes 90 degrees in phase due to the length of the conductive paths and further changes an additional 180 degrees in phase by the cross connection provided by the conductive paths. This 270-degree offset signal in phase is combined with the signal received at bow-tie antenna A which has already changed 90 degree in phase. Because the two signals are 180 degrees different in phase from each other, both signals are cancelled at feed point F1 of bow-tie antenna A. As a result, the combination bow-tie antenna exhibits a unidirectional beam pattern. The above-mentioned effects occur over a wide frequency range so long as the conductive paths have the same phase velocity as the propagating path of the signal.

However, it is noted that if the feed point is changed from F1 of bow-tie antenna A to F2 of bow-tie antenna B, the directivity of the antenna will be reversed. This is a unique use of such an antenna. Further, if two combined bow-tie antennas are placed at right angles over each other as illustrated in FIG. 2, the desired four antenna beam pattern (see FIG. 3) will be obtained by selecting feed point F1 to feed point F2 and/or by selecting one pair of the bow-tie antennas (shown as dotted lines). It is noted that such antenna arrays at right angles have minimum coupling reducing distortion of the beam patterns. It has been found that this arrangement of bow-tie antenna exhibits an antenna beam pattern with approximately 90 degrees beamwidth as well as good front-to-back ratio for rejection of unwanted multipath signals, which is especially important in receiving digital television signals.

It is understood that FIGS. 1–3 are shown by way of examples and that changes in details of structure may be made without departing from the principle of combining bi-directional antennas as described above. For example, the combination of bow-tie antennas can be replaced with that of other kinds of bi-directional antennas, such as a combination of simple dipole antennas.

Figure 4:
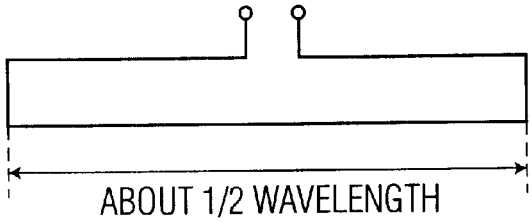
FIG. 4 PRIOR ART
FIG. 4 illustrates the structure of a conventional folded dipole antenna.
Figure 5:
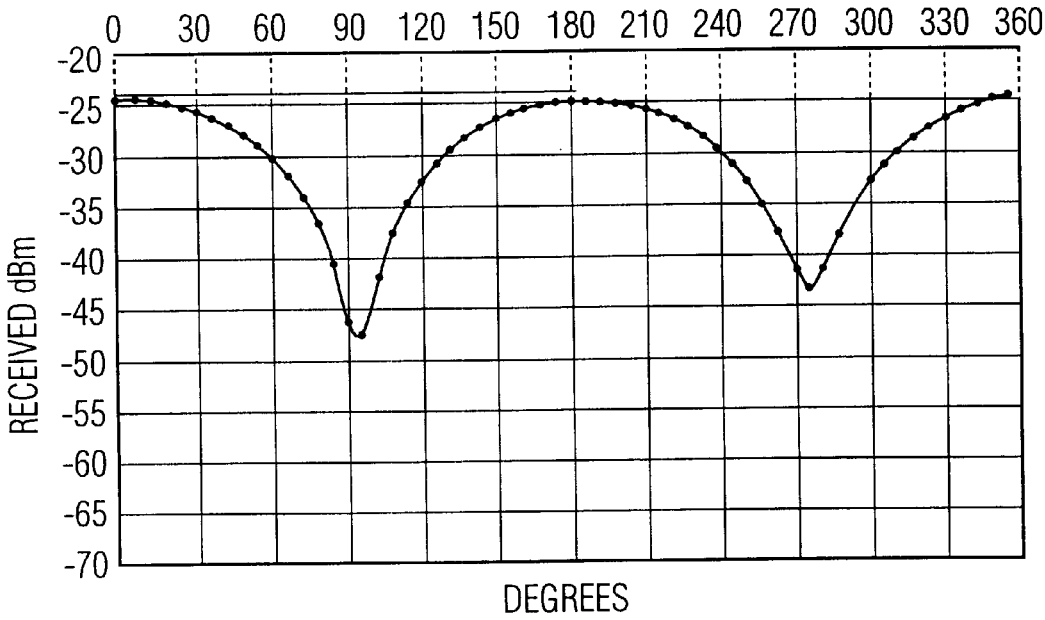
FIG. 5 shows the front-to-back gain ratio of folded bow tie antenna at the frequency of 200 MHz.

FIG. 4 illustrates the structure of a conventional folded dipole antenna. It has been discovered that a folded dipole itself practically, in the horizontal plane, exhibits some degree of front-to-back gain ratio (approximately 2dB). For example, a test result of the front-to-back gain ratio of a folded bow-tie antenna at the frequency of 200 MHz is described in FIG. 5. Even this small amount of directivity can be important for rejecting unwanted multipath signals in receiving digital broadcast signals, such as HDTV signals.

Figure 6:
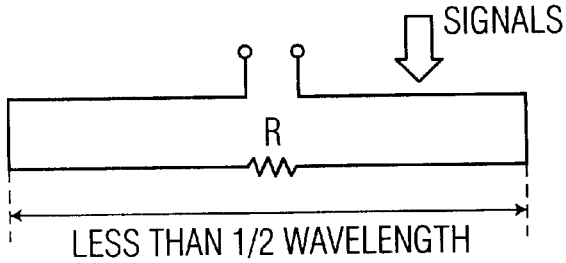
FIG. 6 PRIOR ART
FIG. 6 illustrates the location of load resistance element as applied to a conventional folded dipole antenna.
Figure 7:
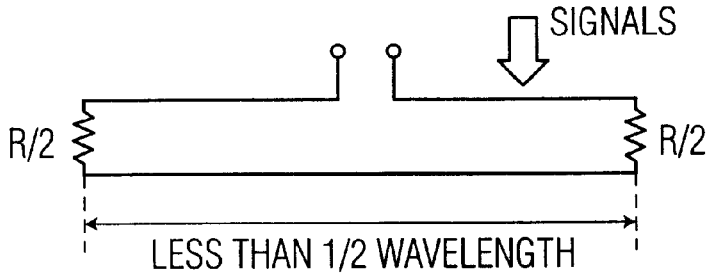
FIG. 7 illustrates the locations of half-value load resistance elements for a unidirectional folded dipole antenna disclosed herein.

The U.S. Pat. No. 2,247,743 entitled "ANTENNA", issued in the name of Harold H. Beverage on Jul. 1, 1941 discloses a unidirectional loop antenna having a load resistance R at a location opposite the feed point as illustrated in FIG. 6. Beverage's antenna operates as a unidirectional antenna for any frequency higher than that frequency for which the dimension of the antenna in the direction of wave travel is substantially less than a half wavelength. It has been discovered that placing a load resistance R like a Beverage's antenna also enhances the uni-directivity of a folded dipole antenna mentioned above. Furthermore, it has also been discovered that the load resistance R can be divided in half, placing two half-value resistances R/2 at the respective ends of the folded dipole elements, without degrading the uni-directivity of the antenna (as illustrated in FIG. 7). Total value of the two half-value load resistances (R/2+R/2) is designed to be greater than the radiation resistance of the antenna elements at the desired frequencies.

Similar to the antenna arrangement shown in FIG. 2, a combination of these unidirectional folded dipoles can be made to have a single 90 degree beam as shown in FIG. 3. It is noted that by placing the half value load resistance at the respective ends of the antenna elements, the design freedom for the physical implementation of the combined antenna structure can be greatly improved. The combination results in an antenna system that can provide four 90 degree beams simply by selecting a proper antenna.

Figure 8:
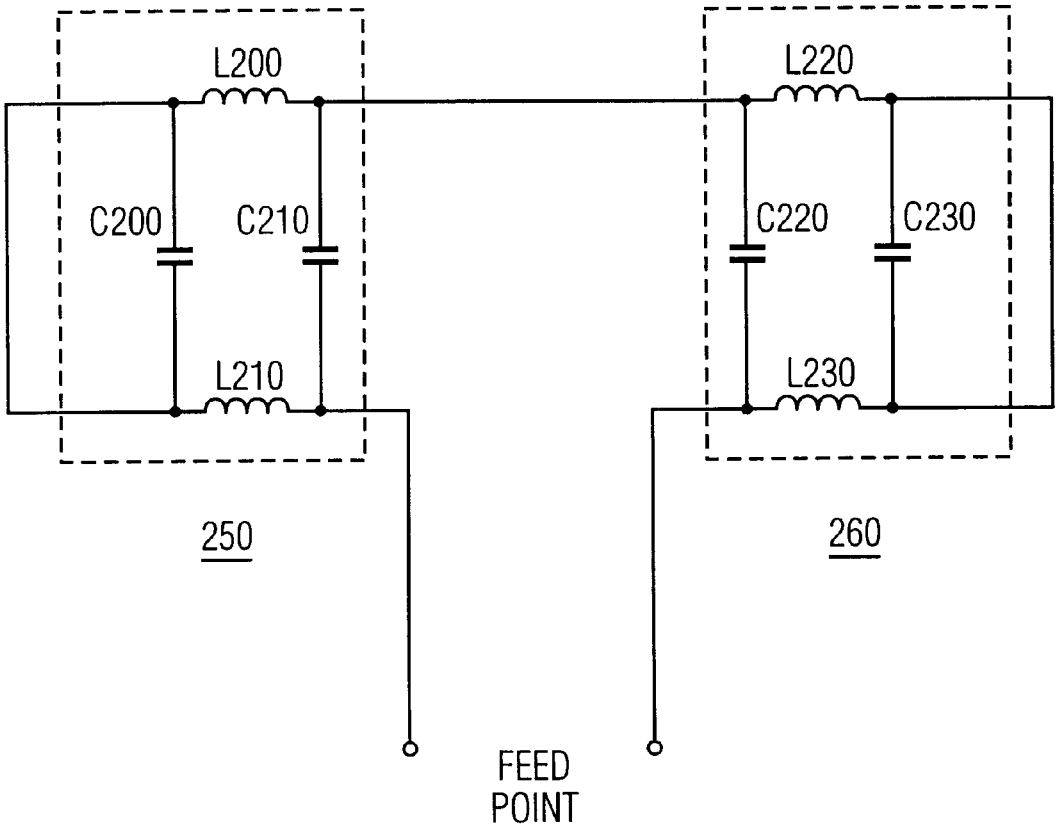
FIG. 8 illustrates a bi-directional folded dipole antenna capable of receiving two different bands of broadcast frequencies.

FIG. 8 illustrates a wideband folded dipole antenna which is capable of receiving two different bands of frequencies (such as VHF and UHF television signals). To extend the range of frequencies covered by the antenna, an extension to the antenna elements can be added with a low pass filter connecting the extended elements as illustrated in FIG. 8. By arranging the low pass filters 250, 260 to include respective shunt capacitors 210, 220, these capacitors provide low impedance paths for high frequencies in a higher frequency band (e.g., UHF television band) such that only the original shorter folded dipole is activated. The series inductors 200,210 and 220, 230 and remaining filter elements isolate the extensions so that they are not active in the high frequency band. For a lower frequency band (e.g., VHF television band), low pass filters 250, 260 exhibit relatively high shunt but low series impedance such that the extensions become activated, and thereby a longer dipole which resonates at the lower frequency band is obtained. Although this wideband folded dipole is bi-directional, such an antenna may still be preferable over a unidirectional folded dipole under certain circumstances—such as receiving weak signals with little multipath interference. This is because the load resistance of the unidirectional folded dipole imposes some losses on the received signals.

Figure 9:
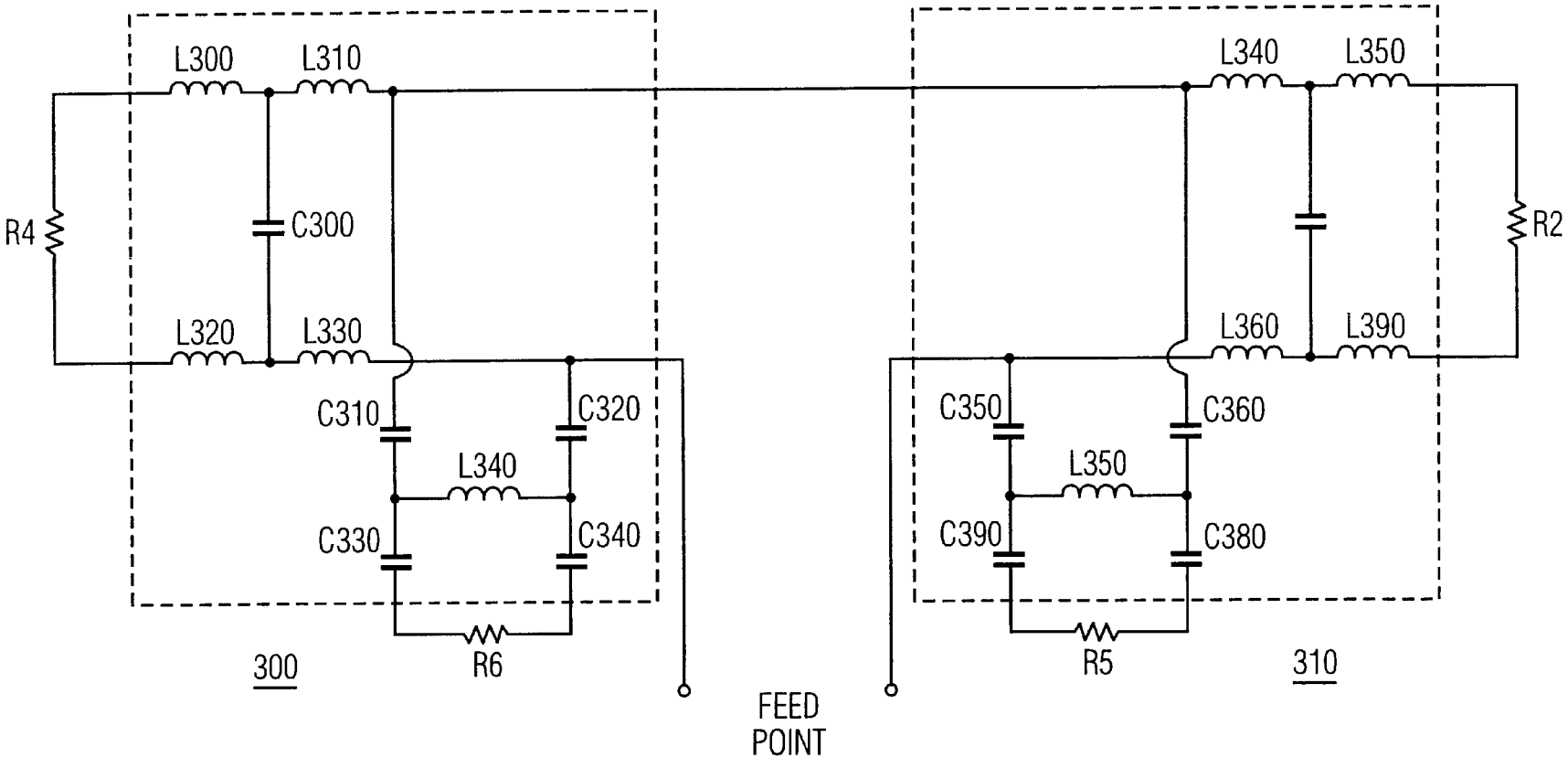
FIG. 9 illustrates a unidirectional folded dipole antenna capable of receiving two different bands of broadcast frequencies.

FIG. 9 illustrates a wideband unidirectional folded dipole antenna which is capable of receiving two different bands of frequencies. Compared with the antenna arrangement illustrated in FIG. 8, load resistors R2, R4 have been added at both edges of the respective elements. The values of the load resistors R2 and R4 may be 150 Ω respectively. As described above, by making the antenna less than a half wavelength and the sum of these resistors larger than the radiation resistance, a signal 90 degree beam can be obtained in the direction of the feed point. Front-to-back ratio is improved at the expense of less received signal.

Further, this antenna can also be made into two sections connected by diplex filters 300, 310. The inner section is made with length less than a half wavelength for high frequency band signals (e.g., UHF television signals). Diplex filters 300, 310 have two functions. One is to substantially connect higher frequency signals to respective load resistors R5, R6, and the other is to connect lower frequency signals (e.g., VHF television signals) to an extended length of antenna elements such that the two sections are appropriately less than a half wavelength at the lower frequency band signals.

Although the present invention has been described with a certain degree of particularity, it is understood that the present disclosure has been made by way of examples and that changes in details of the antenna structure may be made without departing from the spirit of the invention. For example, the wideband unidirectional antenna can be used for receiving signals other than the digital or analog television broadcast signals described herein.

I claim:

1. A broadband antenna comprising:

a closely-spaced pair of elongated conductors, each one of said conductors having a length substantially less than half the wave length of a receiving frequency;

a pair of load means each having a respective resistance value for coupling the ends of one of said conductors to the respective ends of the other conductor for providing a unidirectional beam pattern; and a feed point being located substantially at the center of one of said conductors.

2. The broadband antenna of claim 1 wherein:

the total resistance value of said pair of load means is substantially greater than the total radiation resistance of said pair of conductors at said receiving frequency.

3. The broadband antenna of claim 1 wherein:

said elongated conductors are spaced apart a distance substantially equal to or less than a quarter of the wave length of said receiving frequency.

* * * * *